United States Patent [19]

Bindl

[11] Patent Number: 4,524,726

[45] Date of Patent: Jun. 25, 1985

[54] UTILITY WATER BOILER

[76] Inventor: Max Bindl, Wernberger Strasse 41, D-8473 Pfreimd, Fed. Rep. of Germany

[21] Appl. No.: 567,963

[22] Filed: Jan. 4, 1984

[30] Foreign Application Priority Data

Feb. 11, 1983 [DE] Fed. Rep. of Germany ..... 8303845

[51] Int. Cl.[3] ..... F22B 5/00

[52] U.S. Cl. ..... 122/13 R; 122/32; 126/361; 126/427; 126/435

[58] Field of Search ..... 122/13 R, 14, 16, 18, 122/19, 27, 31 R, 32, 33; 126/350 R, 361, 427, 437, 433, 435; 165/156

[56] References Cited

U.S. PATENT DOCUMENTS 4,222,350 9/1980 Pompei et al. ..... 122/33
4,253,446 3/1981 Muller ..... 126/427
4,282,861 8/1981 Roark ..... 122/32
4,285,334 8/1981 Collins ..... 126/437
4,357,932 11/1982 Stacy ..... 126/433
4,415,119 11/1983 Borking et al. ..... 122/16

*Primary Examiner*—Edward G. Favors
*Assistant Examiner*—Steven E. Warner
*Attorney, Agent, or Firm*—Jacobs & Jacobs

[57] ABSTRACT

A liquid boiler, particularly a utility water boiler, has internal walls dividing the interior of a tank into auxiliary spaces communicating with each other and with the rest of the inner space of the tank, a heat exchanger is in one of the auxiliary spaces, the auxiliary spaces and the heat exchanger being arranged such that liquid removed from the tank and recirculated to the auxiliary space without the heat exchanger will then flow through the auxiliary space with the heat exchanger and then return to the inner space of the tank.

9 Claims, 8 Drawing Figures

UTILITY WATER BOILER

The present invention relates to a liquid boiler, particularly a utility-water boiler, consisting of a tank with connections extending into the inner space of the tank for the feeding and removal of the liquid and of at least one heat exchanger forming at least one closed conduit for the heat-carrier fluid, said heat exchanger being arranged in the inner space of the tank, preferably in the region of the bottom of the boiler.

Liquid boilers (utility-water boilers) are known in numerous embodiments and are used, in particular, for obtaining hot water, for instance in solar energy plants, in plants with heat pumps or in traditional heating installations.

Today a type of construction has, increasingly gained acceptance, in which the cylindrically developed tank (boiler) is operated in upright position, i.e. the axis of its cylinder is in vertical direction. By a special development of the heat exchangers used and their arrangement in the inner space of the tank an attempt has been made to improve the conditions with respect to the heat transfer between the heat-carrier fluid and the liquid (for instance water) in the inner space of the tank. Optimum conditions, however, cannot be obtained with the known liquid or utility-water boilers.

The object of the present invention is to provide a liquid boiler which is of substantially improved thermal efficiency as compared with known boilers.

In order to achieve this object, a liquid or utility-water boiler of the type described above is developed, in accordance with the invention, in the manner that the tank contains at least one auxiliary space which is separated by at least one wall from the inner space of the tank, that said at least one heat exchanger is arranged on said wall in the region of at least one opening which is present in said wall, and that on the outside of the tank a first auxiliary connection which debouches into the auxiliary space and can be connected with the outlet of a circulating or charging pump as well as a second auxiliary connection which debouches into the inner space of the tank and can be connected with the inlet of the charging or circulating pump are provided.

By this development it is possible, in principle, to remove colder liquid from the inner space of the tank by means of the charging and circulating pump and introduce said liquid into the auxiliary space. The liquid can then return into the inner space of the boiler via the opening provided in the vicinity of said at least one heat exchanger (in the wall separating the auxiliary space from the inner space of the tank), the liquid which emerges from said at least one opening flowing directly past the heat exchanger or a part of said heat exchanger. In this way there is obtained a very intensive flow around the heat exchanger and thus a substantial increase in the thermal efficiency.

In one embodiment of the invention, the auxiliary space is surrounded by said at least one heat exchanger at the wall separating said auxiliary space from the inner space of the tank. Said wall can be developed in such a manner that the auxiliary space extends in the axial direction of the cylindrically shaped tank from the end wall forming the bottom of the tank into the inner space of the tank. The second auxiliary connection preferably debouches below said at least one heat exchanger into the inner space of the tank.

As heat exchanger there is preferably used at least one pipe coil which surrounds the auxiliary space in coiled, and preferably, spiral form. If the auxiliary space extends in the above-described manner in the direction of the axis of the tank, there is obtained through said at least one opening in the wall of the auxiliary space a liquid outlet the direction of which lies at least initially transverse or perpendicular to the axis of the tank. Said at least one opening is arranged in the wall of the auxiliary space slightly below the pipe coil or else between the top and the bottom of said pipe coil. In this way the result is obtained that the liquid emerging from the auxiliary space passes, flowing around the individual turns of the pipe coil, outward radial to the axis of the tank and in this way there is a very intensive heat exchange between the heat-carrier fluid in the pipe coil and the liquid.

In another preferred embodiment of the invention, at least two auxiliary spaces are formed by at least two walls or partition walls, at least one heat exchanger being arranged in one auxiliary space and said one auxiliary space being in communication with the inner space of the container via at least one opening. The other auxiliary space is in communication via an opening with said one auxiliary space, the opening which connects said one auxiliary space with the inner space of the tank and the opening which connects the two auxiliary spaces with each other being so arranged on different sides of the heat exchanger that a flow path results from the auxiliary space not containing the heat exchanger through the auxiliary space containing the heat exchanger into the inner space of the tank, said flow path extending along the heat exchanger within the auxiliary space having the heat exchanger, i.e., in the case of a vertical boiler extending transverse or perpendicularly to the axis of the boiler. In this embodiment also there are preferably used heat exchangers which are formed of at least one coiled or spirally bent pipe coil.

Further developments of the invention form the object of the subordinate claims.

The invention will be explained in further detail below, based on an illustrative embodiment shown in the drawings, in which.

Figure 1:
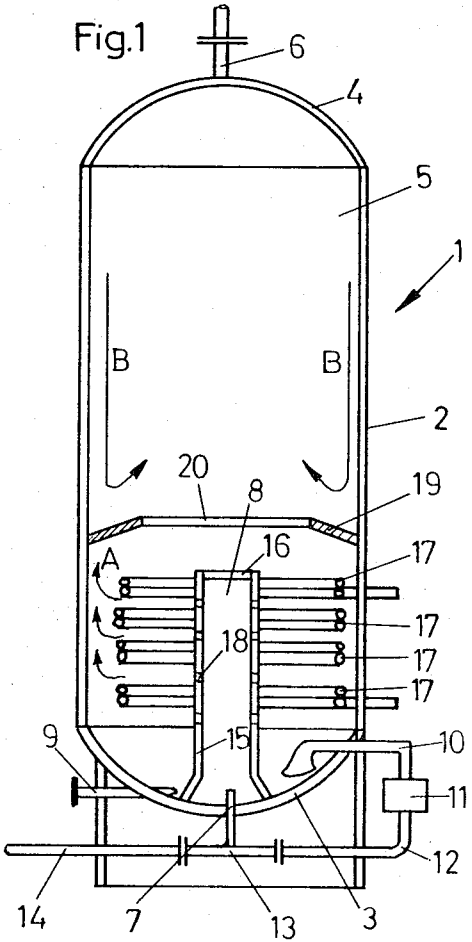
FIG. 1 is a longitudinal section through a utility-water boiler in accordance with a first embodiment of the invention.

The utility water boiler shown in FIG. 1 consists of a tank 1 which has a cylindrical, closed circumferential wall 2, a bottom 3 which is also closed and curved convexly towards the outside, and a cover 4. The circumferential wall 2, the bottom 3 and the cover 4 close the inner space 5 of the tank 1 off from the outside. In the middle of both the cover 4 and of the bottom 5 there are provided pipe connections 6 and 7 respectively, the connection 6 which serves for the discharge of the hot water debouching into the inner space 5 of the boiler 1 while the pipe connection 7 debouches into an auxiliary space 8 provided in the tank 1. On the bottom 3 there are two additional pipe connections 9 and 10.

The pipe connection 10, which forms the "second auxiliary connection" is connected to the inlet of a charging pump 11 the outlet of which is connected via a pipeline 12 to the one inlet of a tee 13. The outlet of the tee 13 is connected to the connection 7 so that the inlet of the tee 13 which is connected to the pipeline 12 forms, in combination with the connection 7, the "first auxiliary connection." To the other inlet of the tee 13 there is connected a pipeline 14 which serves as cold-water feed.

The auxiliary space 8 is developed as a circular cylinder; its axis is coaxial to the axis of the tank 1 and is closed at the bottom by a part of the bottom 3. For the separating of the auxiliary space 8 from the inner space 5 of the tank 1 there is used a wall 15 of substantially circular cylindrical shape which is coaxial to the axis of the tank 1 and has an upper closure wall 16 in the form of a circular disk. The diameter of the cylindrical auxiliary space 8 is smaller than the diameter of the inner space 5. Around the wall 15 there are arranged, in the portion of the inner space 5 located there, a plurality of pipe coils 17 which form the heat exchanger. In the embodiment shown, the heat exchanger consists of a total of four pipe coils. These pipe coils are in each case developed spirally and in two layers, i.e. each pipe coil consists of a lower layer 17′ and an upper layer 17″ of spirally extending turns which are connected to each other in suitable manner to form a single continuous pipe coil 17. The planes formed by the individual pipe coils 17 or their turns lie perpendicular to the axis of the tank 1. The inlets and outlets of the individual pipe coils 17 may be connected, inside or outside the boiler 1, to each other and to a common inlet and outlet for the heat-carrier fluid which flows through the pipe coils 17.

As shown very clearly in FIG. 1, the auxiliary space 8 is located in the center of the stack of pipe coils 17 arranged one above the other. In the wall 15 there are provided openings 18 through which the auxiliary space 8 is in communication with the inner space 5. In each, case one opening 18 or group of openings 18 is located in the region of a pipe coil 17, each opening 18 associated with a pipe coil 17, or at least a part of the openings 18 associated with a pipe coil 17, lying preferably slightly below the corresponding pipe coil 17.

Below the heat exchanger formed by the pipe coils 17 there is located the mouth opening of the connection 10 which leads into the inner space 5. The mouth opening is funnel-shaped and is arranged in such a manner that it faces the bottom 3. In this way, assurance is had that the charging pump 11 draws water out of the immediate region of the bottom 3 via the connection 10.

Above the heat exchanger which is formed by the pipe coils 17 there is fastened to the inner surface of the circumferential wall 2 a conical ring 19 serving as baffle wall which divides the inner space 5 of the tank 1 into an upper partial space and a lower partial space which are connected to each other by the annular opening 20.

Figure 2:
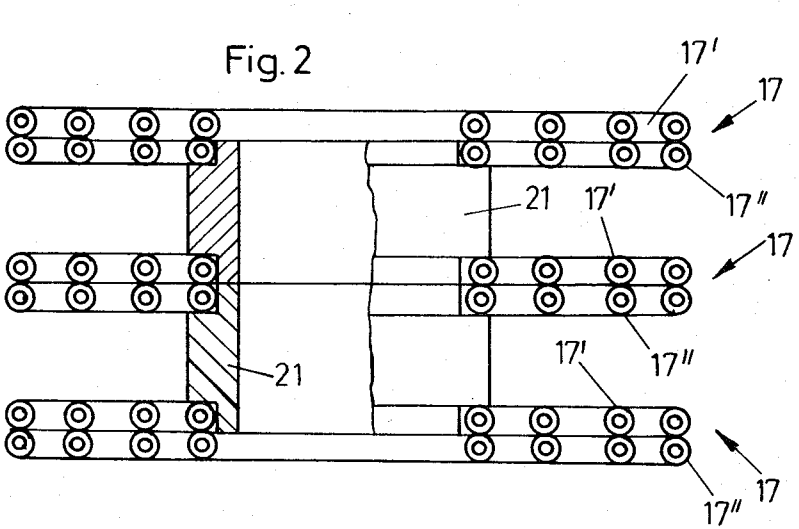
FIG. 2 shows, on a larger scale, three two-layer spiral pipe coils of the heat exchanger of FIG. 1, together with the wall of the auxiliary space, which wall is formed of a plurality of rings placed one above the other.
Figure 4:
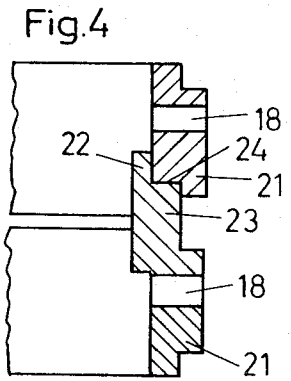
FIG. 4 is a section along the line I—I of FIG. 3.
Figure 3:
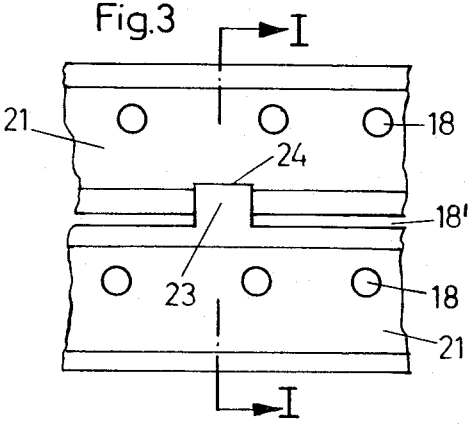
FIG. 3 shows, on a larger scale, two adjacent rings in the region of their upper and lower edges.

As can be noted, in particular, from FIG. 2, the wall 15 consists of a plurality of annular parts 21 placed one above the other, each of which has the same constant inside diameter but their outer surface being in each case so developed that the outside diameter is smaller at the two ends of each part 21 than in the central region. In this way, after the placing of two parts 21 on each other at the connecting place of these parts, an annular groove is formed in which the inner turns of a pipe coil lie at least in part, as a result of which the individual pipe coils 17 are secured against slipping and the required spacing between the individual pipe coils 17 is assured. The parts 21 are secured against undesired lateral slippage by the pipe coil 17, which is arranged in each case between two parts. An additional securing can be obtained here, in accordance with FIG. 4, in the manner that several radially inwardly offset protruding extensions 22 lying against the inner surface of the adjacent part 21 are provided on the upper and/or lower end edge of each part 21.

The openings 18 are arranged in the wall of each part 21 at the place where said part has the largest outside diameter. The uppermost part, which is provided with a closure wall 16 then has no openings 18.

Instead of the openings 18, or in addition to them, slit-like openings 18′ can be left between the parts 21, for instance in the manner that at the upper edge of each part 21 extensions 23 which protrude beyond this edge are provided via which the part 21 in question rests against an adjacent part, these extensions 23 lying preferably, over a part of their height or length, within recesses 24 of the adjacent annular part.

The manner of operation of the boiler can be described as follows:

When the tank 1 is completely full of water and hot water is taken from the connection 6, a corresponding amount of cold water will flow in through the pipeline 14 and pass via the connection 7, the auxiliary space 8 and the openings 18 or 18′ into the inner space 5, the water which emerges from the openings 18 and 18′ flowing intensively around the pipe coil 17.

In addition to the feeding of cold water, the charge pump 11 produces a continuous circulation of water in the space below the ring 19 in the manner that colder water in the region of the bottom 3 is forced into the auxiliary space 8 and emerges at the openings 18 and 18′ present there back into the inner space 5 of the tank, also with intimate flow around the pipe coils 17. As soon as the water circulating in this manner has been heated to a given temperature, it passes through the annular opening 20 into the part of the inner space 5 above the ring 19. Within this space, circulation of the water also takes place corresponding to the arrows B, which, to be sure, is due solely to the rising of hot water and the descending of cold water.

Figure 5:
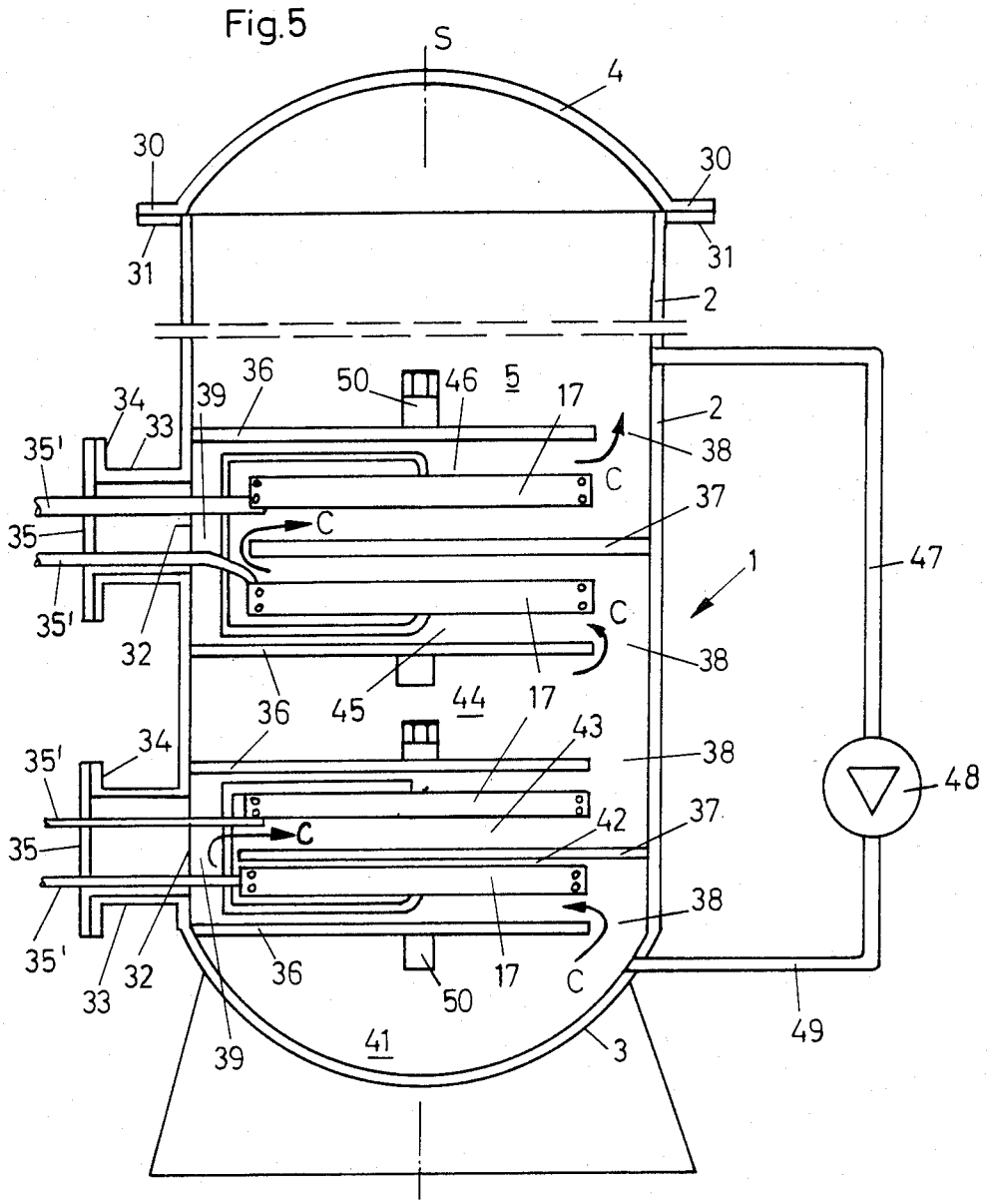
FIG. 5 is a longitudinal-section through a utility-water boiler according to another embodiment of the invention in which a plurality of auxiliary spaces are formed within the tank by partition walls lying transverse to the axis of the tank.

The utility-water boiler shown in FIG. 5 consists of a tank 1 with circumferential wall 2 as well as bottom 3 and cover 4, the latter having an annular flange 30 and being fastened removably by this flange to a flange 31 of the circumferential wall 2, so that the heat exchanger 17 can be inserted from above (with the cover 4 removed) into the tank and, if necessary, replaced. Within the tank 1 two groups of two heat exchangers 17 each are arranged one above the other. With each group there is associated in the circumferential wall 2 a circular opening 32 which debouches into a pipe-shaped connecting socket 33 which protrudes beyond the outer surface of the circumferential wall 2 and is tightly connected to the circumferential wall, said socket being provided at the end thereof lying away from the circumferential wall 2 with an annular, radially outward extending flange 34. A disk-shaped cover plate 35 is thus screwed onto each flange 34.

Figure 6:
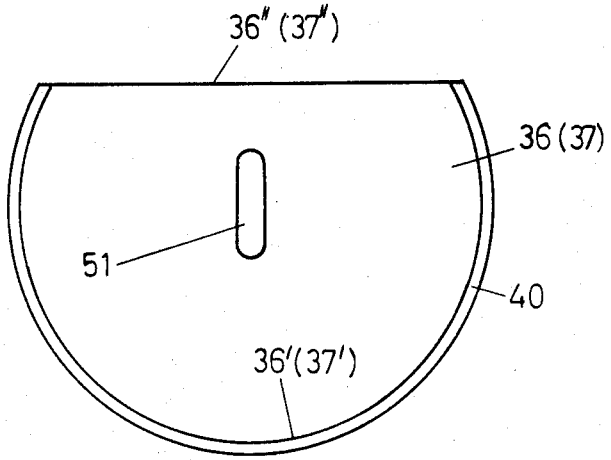
FIG. 6 is a top view of a partition wall in accordance with FIG. 5.

In order, in the embodiment shown in FIG. 5, to improve the efficiency of the heat exchangers 17 or for this purpose to produce within the region of the heat exchangers 17 a flow of the fluid (for instance water) present in the container 1 which (flow) extends in the direction of the planes formed by the spiral pipe coils, several partition walls 36 and 37 are provided within the tank 1 in the region of the heat exchangers 17, the surfaces of said walls lying parallel to the planes formed by the pipe coils of the heat exchangers 17, i.e. also perpendicular to the axis S of the tank 1. All partition walls 36 and 37 have the same partially circular shape shown in FIG. 6. The partition walls 36, which are provided on each side of a connection socket 33, lie with their peripheral edge sealed against the inner surface of the circumferential wall 2. Between the inner surface of the circumferential wall 2 and the secant-like, edge line 36'' an opening 38 remains at each partition wall 36, namely at the side of the partition wall opposite the connection socket 33. The partition walls 37 have their peripheral edge 37' which is developed as a circular arc resting in sealed manner against the inner surface of the circumferential wall 2. The secant-like edge line 37'' of each partition wall 37 lies adjacent to the corresponding connection socket 33 so that an opening 39 is formed at each connection socket 33. Each partition wall 37 lies between two partition walls 36, and a heat exchanger 17 is arranged in the space between each partition wall 36 and the adjacent partition wall 37. In order to obtain a tight closure between the inner surface of the circumferential wall 2 and the edge lines 36' and 37', the partition walls are provided at these edge lines with a sealing element 40 of elastic material. The connection sockets 33 and their axes lie on a common line of the circumferential wall 2 which extends parallel to the axis S.

By the partition walls 36 and 37 there are formed a plurality of auxiliary spaces 41 to 46 which are in communication with each other and with the rest of the inner space of the tank 1 via the openings 38 and 39 and by which (corresponding to the arrows C) a zigzag flow from bottom to top is imposed upon the fluid present in the tank, the flow extending perpendicular to the axis S within the auxiliary spaces 42 to 46. This zigzag flow, which increases the cfficiency, is obtained, first of all, when cold water is fed into the inner space of the tank 1 (upon the removal of hot water) via the pipe connection 9 which debouches into the auxiliary space 41. The zigzag flow is, however, also continuously maintained in the manner that, via a pipe connection 47, water is drawn out of the inner space 5 of the tank 1 above the upper partition wall 36 by the circulating pump 48 and returned into the auxiliary space 41 via the pipe connection 49. The embodiment shown in FIG. 5 has the particular advantage over the embodiment of FIG. 1 that a relatively small cross section of flow results for the flow along the heat exchangers 17 (through the auxiliary spaces 42, 43, 45 and 46 defined by the partition walls 36 and 37) so that a circulating or charging pump 48 of relatively small capacity can be used.

Figure 7:
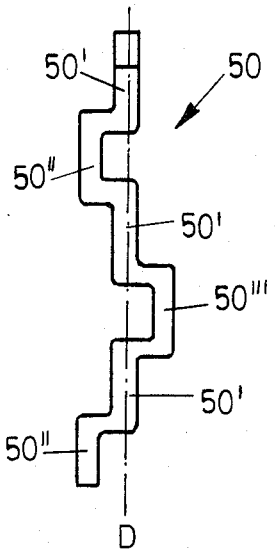
FIG. 7 shows an element serving for the positioning and holding of the partition walls in the embodiment of FIG. 5.
Figure 8:
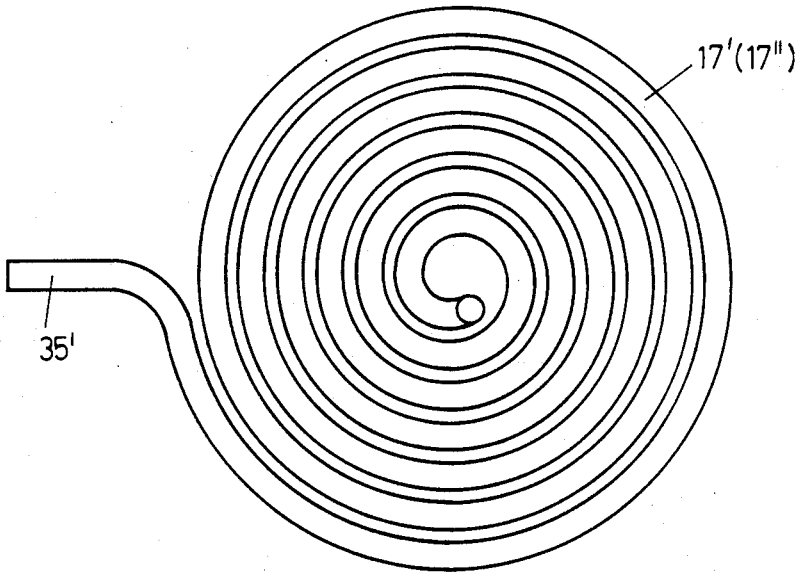
FIG. 8 shows, in top view, a spiral pipe coil of the heat exchanger for use in the utility-water boilers according to FIGS. 1 and 5.

For the holding of the partition walls 36 and 37 there are provided two holding elements 50, each of which consists of a metal bar bent in the shape of a crankshaft. Each holding member 50 has a total of three sections 50' whose lengthwise directions lie in a common axis D, two further sections 50'' which are also arranged on a common axis extending at a distance from and parallel to the axis D, and a section 50''' which again extends parallel to the axis D but, referred to the axis D, is shifted 180° from the sections 50''. Each holding element 50 is turnably mounted via its section 50' which is at the bottom in FIG. 7 and the section 50' lying above same in the center of the two heat exchangers 17 of a heat-exchanger group, and engages by means of the sections 50'' into a slot 51 in a partition wall 36, while the section 50''' is passed through the slot 51 in the partition wall 37. The upper section 50' is of hexagon-shaped cross section for application of a wrench. The two heat exchangers 17 of a heat-exchanger group are pre-assembled, together with the corresponding intermediate ends 36 and 37, and the holding element 50 outside the tank 1 and introduced into the tank in this pre-assembled condition. After the fastening of the heat exchangers 17 and their connections 36' to the cover plates 35, the holding element 50 is so turned by means of the wrench that the circular edge lines 36' and 37' of the partition walls 36 and 37 rest pressed firmly against the inner surface of the circumferential wall 2. In order that, the zigzag flow through the auxiliary spaces is impaired as little as possible, the slots 51 in the auxiliary walls 36 and 37 are made small. In principle it is also possible to provide sealing elements which seal off the region of the slots 51 not taken up by the sections 50'' and 50'''.

It is, of course, also possible to connect the partition walls 36 and 37 firmly, by welding, to the inner surface of the circumferential wall 2. In that case it is then necessary, to be sure, after the introduction of each partition wall 36 or 37, first of all to install the heat exchanger 17 located above it. With this development it is then no longer possible to replace defective heat exchangers 17. Furthermore, in this case it is necessary to apply the necessary layer of corrosion protection to the parts present in the inner space of the tank 1 only after the installing of the heat exchangers 17 and the partition walls 36 and 37. This has certain disadvantages since the heat transfer at the heat exchangers is increased as a result of the material forming the corrosion protection layer, particularly if these heat exchangers consist of a pipe material which, in order to increase its surface, is provided on its outer side with ribs and depressions between them, which could easily become closed off by the corrosion protective layer.

The bottom 3 is connected by a weld seam 52 to the circumferential wall 2. In order to arrange the bottom heat exchanger 17 as low as possible in the tank 1, it is necessary to arrange the weld seam 52 as close as possible to the lower connection socket 33. In order, in this case, to produce the weld seam 52 in a single operation it is necessary to place at least the lower connection socket 33 and its flange 34 on the tank 1 only after the weld seam 52 has been completed. This measure is in itself independent of the development of the heat exchangers 17 and, in particular, also independent of whether partition walls or auxiliary spaces formed by them are used to increase the efficiency.

I claim:

1. A liquid boiler, particularly a utility-water boiler, which comprises a tank with connections extending into the inside of the tank for the feeding and removal of the liquid; at least two walls within said tank spaced apart from one another to define at least two auxiliary spaces, said auxiliary spaces being separated from one another and from the rest of the inner space of said tank by said walls, said walls having openings therein for connecting said auxiliary spaces with each other and with the rest of the inner space of said tank; at least one heat exchanger which forms at least one closed conduit for a heat carrier fluid arranged in one of said auxiliary spaces and arranged on one of said walls in the region of at least one of said openings, said opening connecting one auxiliary space with the other auxiliary space and said opening connecting one auxiliary space with the inner space of said tank beig arranged on different sides of said at least one heat exchanger; a first auxiliary connection in communication with one of said auxiliary spaces and adapted to be connected with the outlet of a circulating or charging pump; and a second auxiliary connection communicating with said inner space of said tank, said second auxiliary connection being adapted to be connected to the inlet of said charging or cirulating pump for carrying the liquid.

2. A liquid boiler according to claim 1, wherein said walls which form said at least two auxiliary spaces have their surface sides lying transverse and perpendicular respectively to the axis of said tank.

3. A liquid boiler according to claim 1 or 2, wherein said first auxiliary connection debouches into the other of the said at least two auxiliary spaces which does not have said at least one heat exchanger.

4. A liquid boiler according to claim 1, wherein a plurality of auxiliary spaces is provided each of which has at least one heat exchanger and which are separated in each case from each other by walls and connected with one another by openings, at least one of said auxiliary spaces being in communication via an opening with said inner space of said tank.

5. A liquid boiler according to claim 1, wherein a part of the edge of at least one wall is pressed against the inner surface of the wall of said tank by a crank-shaft-like holding element which is preferably mounted for rotation in said at least one heat exchanger.

6. A liquid boiler according to claim 1, wherein in the case of a cylindrical development of said tank, said walls are made partially circular for the formation of said openings.

7. A liquid boiler according to claim 1, wherein said openings of two adjacent walls lie, with respect to the axis of said tank, on different sides of said axis.

8. A liquid boiler according to claim 1, wherein said at least one heat exchanger is formed by at least one pipe coil, preferably a spirally shaped pipe coil.

9. A liquid boiler according to claim 8, wherein said at least one spirally shaped pipe coil has the planes formed by its turns transverse of perpendicular to the axis of the boiler.

* * * * *